US007912410B2

(12) United States Patent
Takahashi et al.

(10) Patent No.: US 7,912,410 B2
(45) Date of Patent: Mar. 22, 2011

(54) DEVELOPING DEVICE, A PROCESS CARTRIDGE AND AN IMAGE FORMING APPARATUS INCLUDING A TONER CARRIER AND A VOLTAGE SUPPLY

(75) Inventors: Tomoko Takahashi, Kanagawa (JP); Yasuyuki Ishii, Tokyo (JP); Hideki Kosugi, Kanagawa (JP); Ichiro Kadota, Kanagawa (JP); Masaaki Yamada, Tokyo (JP); Yoshinori Nakagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 116 days.

(21) Appl. No.: 12/205,240

(22) Filed: Sep. 5, 2008

(65) Prior Publication Data

US 2009/0067879 A1 Mar. 12, 2009

(30) Foreign Application Priority Data

Sep. 10, 2007 (JP) ..... 2007-234559

(51) Int. Cl.
*G03G 15/08* (2006.01)

(52) U.S. Cl. ..... 399/266; 399/270; 399/272

(58) Field of Classification Search ..... 399/265–267, 399/270, 272

See application file for complete search history.

(56) References Cited

U.S. PATENT DOCUMENTS 6,122,473 A * 9/2000 Goseki et al. ..... 399/286
6,658,227 B2 12/2003 Oyama et al.
6,708,014 B2 3/2004 Miyaguchi et al.
6,721,534 B2 4/2004 Takahashi
6,856,780 B2 2/2005 Kadota et al.
6,947,691 B2 9/2005 Miyaguchi et al.
7,212,753 B2 5/2007 Suzuki et al.
7,308,222 B2 * 12/2007 Nakagawa et al. ..... 399/265
7,313,336 B2 12/2007 Kadota et al.
7,340,204 B2 3/2008 Nakazato et al.
7,359,660 B2 4/2008 Nakazato et al.
2006/0216071 A1 9/2006 Yamada et al.
2006/0251449 A1 11/2006 Takahashi et al.

(Continued)

FOREIGN PATENT DOCUMENTS

JP 3-21967 1/1991

(Continued)

OTHER PUBLICATIONS

U.S. Appl. No. 12/170,930, filed Jul. 10, 2008, Takahashi, et al.

(Continued)

*Primary Examiner* — Hoang Ngo
(74) *Attorney, Agent, or Firm* — Oblon, Spivak, McClelland, Maier & Neustadt, L.L.P.

(57) ABSTRACT

A developing device for a toner powder cloud development system, which can achieve high image quality and can be made compact. The developing device has a two-component development unit, a toner carrier, and an alternating current power source. The toner carrier, which is arranged opposing a latent image carrier, has a plurality of electrodes disposed in a line in a prescribed direction on the surface thereof, and mutually insulated. The alternating current power source supplies a voltage such that an electric field across the plurality of electrodes is temporally switched. The inter-electrode electric field causes the toner being carried on the surface of the toner carrier to carry out hopping, thereby forming a toner powder cloud and carrying out development. The movement speed of the latent image carrier and the linear velocity of the toner carrier are set at approximately equivalent speeds.

22 Claims, 14 Drawing Sheets

U.S. PATENT DOCUMENTS

| | | | |
|---|---|---|---|
| 2007/0013924 | A1 | 1/2007 | Sakai et al. |
| 2007/0015071 | A1 | 1/2007 | Tsukamoto et al. |
| 2007/0086811 | A1 | 4/2007 | Tsukamoto et al. |
| 2007/0098449 | A1 | 5/2007 | Kadota et al. |
| 2007/0160395 | A1 | 7/2007 | Kosugi et al. |
| 2007/0212121 | A1 | 9/2007 | Takahashi et al. |
| 2007/0242985 | A1 | 10/2007 | Aoki et al. |
| 2008/0089720 | A1 | 4/2008 | Tsukamoto et al. |
| 2008/0089723 | A1 | 4/2008 | Tsukamoto et al. |
| 2008/0124138 | A1 | 5/2008 | Kosugi et al. |
| 2008/0214138 | A1 | 5/2008 | Kosugi et al. |

FOREIGN PATENT DOCUMENTS

| | | |
|---|---|---|
| JP | 3-100575 | 4/1991 |
| JP | 3-113474 | 5/1991 |
| JP | 9-269661 | 10/1997 |
| JP | 2002-341656 | 11/2002 |
| JP | 2003-15419 | 1/2003 |
| JP | 2003-84560 | 3/2003 |
| JP | 2004-286837 | 10/2004 |

OTHER PUBLICATIONS

U.S. Appl. No. 12/205,314, filed Sep. 5, 2008, Nakagawa, et al.

* cited by examiner

FIG. 14

| IMAGE LINEAR VELOCITY [mm/s] | IMAGE STATUS |
|---|---|
| 50 | POSTERIOR PORTION OF IMAGE HAS THINNED OUT |
| 100 | UNIFORM BETA IMAGE PRODUCED |
| 150 | POSTERIOR PORTION OF IMAGE IS THICK |
| 200 | POSTERIOR PORTION OF IMAGE IS THICK |

DEVELOPING DEVICE, A PROCESS CARTRIDGE AND AN IMAGE FORMING APPARATUS INCLUDING A TONER CARRIER AND A VOLTAGE SUPPLY

BACKGROUND OF THE INVENTION

1. Field of the Invention

The present invention relates to a developing device for developing an electrostatic latent image that has been formed on a latent image carrier, a process cartridge that integrally comprises this developing device, and an image forming apparatus, such as a multifunctional machine, which comprises at least one of a copier, printer, facsimile machine and plotter that comprises either this developing device or process cartridge.

2. Description of the Related Art

The developing device used in a copier, printer, facsimile machine and other such image forming apparatuses to date has been either a two-component development system or a one-component development system. The two-component development system is extremely well suited to high-speed developing, and is the mainstream system for present-day medium-speed and high-speed image forming apparatuses.

In the two-component development system, the developer on the contact part of the electrostatic latent image on the latent image carrier must be in an extremely dense state in order to strive for high quality. For this reason, efforts to make carrier particles smaller are currently being pushed forward, and carriers of around 30 μm are coming into use at the commercial level.

The one-component development system is currently the mainstream system for low-speed image forming apparatuses due to the fact that the mechanism is compact and lightweight. In the one-component development system, a blade, roller and other such toner regulating members are allowed to make contact with the toner on the development roller to form a thin layer of toner on the development roller, and the toner is electrostatically charged at this time by the friction between the development roller, toner regulating members and the toner. The charged toner layer, which is thinly formed on the development roller, is transported to the development area, and develops a charged latent image on the latent image carrier. The development mode here is broadly divided into a contact type and a non-contact type, the former being a mode in which the development roller and latent image carrier make contact with one another, and the latter being a mode in which the development roller and latent image carrier do not make contact.

To make up for the deficiencies of the above-mentioned two-component development system and one-component development system, a number of hybridized systems that combine a two-component development system and a one-component development system have been proposed, as disclosed, for example, in Japanese Patent Application Laid-open No. H3-100575 (Prior Art 1).

As a method for developing tiny, uniform, high-resolution dots, for example, there is the system disclosed in Japanese Patent Application Laid-open No. H3-113474 (Prior Art 2). In contrast to the above-mentioned hybridized system, this system creates a toner cloud in the development area and realizes the developability of high-resolution dots by installing a wire that applies a high-frequency bias to the development area.

Further, Japanese Patent Application Laid-open No. H3-21967 (Prior Art 3) proposes a method for forming an electric field curtain on a rotating roller to form the most efficient and stable toner cloud.

Further, Japanese Patent Application Laid-open No. 2003-15419 (Prior Art 4) discloses a developing device that transports the developer via an electric field curtain in accordance with a traveling wave field.

Further, Japanese Patent Application Laid-open No. H9-269661 (Prior Art 5) discloses a developing device having a plurality of magnetic poles, which nearly uniformly clamps nearly one layer of carrier to the circumferential surface of the development roller.

Further, Japanese Patent Application Laid-open No. 2003-84560 (Prior Art 6) discloses a developing device that disposes via an insulating part a periodic conductive electrode pattern on the surface of the developer carrier, which carries a non-magnetic toner, generates an electric field gradient in the vicinity of the surface of the developer carrier by applying a prescribed bias potential to these electrodes, thereby adhering and transporting the above-mentioned non-magnetic toner on the above-mentioned developer carrier.

The demand for high image quality is becoming increasingly higher for the two-component development system, and the required pixel dot size itself must be either the same or smaller than the diameter of the current carrier particles. Therefore, from the standpoint of discrete dot reproducibility, carrier particles must be made even smaller.

However, as the size of the carrier is made smaller, the magnetic permeability of the carrier particles declines, increasing the likelihood that the carrier will separate from the development roller. When the separated carrier particles adhere to the latent image carrier, not only does the adherence of the carrier itself give rise to image defects, but various other side effects also occur as a result of this, such as damage to the latent image carrier.

To prevent carrier separation, attempts are being pushed forward on the material side to raise the magnetic permeability of the carrier particles, and efforts are also being made to strengthen the magnetic force of the magnet embedded inside the development roller, but the need to reduce costs while raising image quality is making development extremely difficult.

Further, as the diameter of the development roller becomes increasingly smaller in response to the trend toward miniaturization, it is becoming difficult to design a development roller that has a magnetic field configuration powerful enough to completely suppress carrier separation.

To begin with, since the two-component development system is a process that forms a toner image by rubbing the rests of the two-component developer, called the magnetic brush, against the electrostatic latent image, the unevenness of the crests inevitably gives rise to irregularities in the developability of discrete dots.

It is possible to enhance image quality by forming alternating electric fields between the development roller and the latent image carrier, but it is difficult to completely do away with basic image irregularities, such as the irregularities of the crests of the developer.

Further, in order to enhance transfer efficiency and cleaning efficiency in the step for transferring a toner image that has been developed on the latent image carrier, and the step for cleaning the residual toner left on the latent image carrier subsequent to transfer, the non-electrostatic adhesion between the latent image carrier and the toner must be reduced as much as possible. As a method for lowering the non-electrostatic adhesion between the latent image carrier and the toner, reducing the friction coefficient of the surface of the latent image carrier is known to be effective, but, since the crests of the two-component developer slip smoothly through the development area in this case, development efficiency and dot reproducibility become extremely poor.

In the one-component development system, a layer of toner on the development roller that has been thinned by the toner regulating members makes full press-contact with the development roller, thereby causing the toner responsiveness to the electric field of the development area to become extremely poor. Accordingly, in order to normally achieve high image quality, the mainstream approach is to form a powerful alternating electric field between the development roller and the latent image carrier, but even with the formation of this alternating electric field, it is difficult to stably develop a fixed amount of toner for an electrostatic latent image, and it is difficult to uniformly develop a tiny, high-resolution dot.

Further, since the one-component development system applies an extremely high stress to the toner when forming the thin layer of toner on the development roller, the toner circulating inside the developing device deteriorates extremely rapidly. In line with the deterioration of the toner, irregularities and the like become more likely even in the process for forming the thin layer of toner on the development roller, making the one-component development system unsuitable for high-speed or high-durability image forming apparatuses.

A hybridized system overcomes a number of problems even though the size and number of parts of the developing device itself increase. However, in the end, the development area is still faced with the same problem as that of the one-component development system, that is, developing a tiny, uniform, high-resolution dot is still difficult.

The system disclosed in Prior Art 2 is able to realize highly stable, high image quality development, but the complexity of the developing device configuration cannot be avoided.

The system disclosed in Prior Art 3 can be said to be extremely good at achieving compact size and high image quality development, but as a result of the diligent research of the inventors, it was discovered that the conditions for development and for the electric field curtain that is formed must be strictly limited in order to achieve ideal high image quality. That is, if image creation is carried out using a condition that strays from the appropriate condition, the effectiveness of this system is completely lost, resulting in inferior image quality instead.

Now then, in an image creation process such that a first toner image is formed on the latent image carrier, and a second toner image and third toner image are formed in order thereon, the development system must be one that does not disturb the toner image first formed on the latent image carrier.

It is possible to sequentially form toners of respective colors on the latent image carrier by using a non-contact one-component development system or the toner cloud development system disclosed in Prior Art 2, but since an alternating electric field is formed between the latent image carrier and the development roller in both systems, a portion of the toner is pulled away from the toner image first formed on the latent image carrier, and enters the developing device. Consequently, not only is the image on the latent image carrier disturbed, but there also arises the problem of different colored toners being mixed together inside the developing device. It is crucial that these systems achieve high quality images, and to solve for this problem will require a method that realizes toner cloud development without forming an alternating electric field between the latent image carrier and the development roller.

As a method that is capable of realizing toner cloud development like this, the system disclosed in Prior Art 3 cited above is conceivably effective, but as mentioned above, this system is completely ineffective unless used under the appropriate conditions.

Further, a system such as that disclosed in Japanese Patent Application Laid-open No. 2002-341656 (Prior Art 7) is also a conceivably effective method for electrostatically transporting and developing the toner using an alternating electric field of three or more phases without driving the toner carrier mechanically.

However, the problem posed by this method is that, if for one reason or another, the toner can no longer be transported electrostatically, this toner accumulates on top of the transport substrate, resulting in a loss of functionality.

To solve for this problem, for example, a structure that combines a fixed transport substrate with a toner carrier that moves along the surface thereof has also been proposed, as in the system disclosed in Japanese Patent Application Laid-open No. 2004-286837 (Prior Art 8), but the mechanism becomes extremely complex.

SUMMARY OF THE INVENTION

It is a first object of the present invention to provide a developing device, process cartridge and image forming apparatus via which it is possible to realize higher image quality and, in addition, more compactness than the prior art.

A further object of the present invention is to provide a developing device, process cartridge and image forming apparatus via which it is possible to superimpose colors on the latent image carrier to enable the production of a high-quality full-color image with no displacement.

In an aspect of the present invention, a developing device comprises a toner carrier arranged opposing a latent image carrier; a plurality of electrodes disposed in the toner carrier; and a voltage supplying device for supplying a voltage to the electrodes such that an electric field across the plurality of electrodes is temporally switched. The inter-electrode electric field causes toner carried on a surface of the toner carrier to carry out hopping to form a toner cloud. A latent image formed on the latent image carrier is developed by causing the toner to adhere to the latent image. A movement speed of the latent image carrier and a linear velocity of the toner carrier are set to approximately equivalent speeds.

In another aspect of the present invention, a process cartridge integrally comprises at least a latent image carrier and a developing device, and can be freely attached to and detached from an image forming apparatus main unit. This developing device comprises a toner carrier arranged opposing a latent image carrier; a plurality of electrodes disposed in the toner carrier; and a voltage supplying device for supplying a voltage to the electrodes such that an electric field across the plurality of electrodes is temporally switched. The inter-electrode electric field causes a toner carried on a surface of the toner carrier to carry out hopping to form a toner cloud. A latent image formed on the latent image carrier is developed by causing the toner to adhere to the latent image. A movement speed of the latent image carrier and a linear velocity of the toner carrier are set to approximately equivalent speeds.

In another aspect of the present invention, an image forming apparatus comprises a developing device. This developing device comprises a toner carrier arranged opposing a latent image carrier; a plurality of electrodes disposed in the toner carrier; and a voltage supplying device for supplying a voltage to the electrodes such that an electric field across the plurality of electrodes is temporally switched. The inter-electrode electric field causes a toner carried on a surface of the toner carrier to carry out hopping to form a toner cloud. A latent image formed on the latent image carrier is developed by causing the toner to adhere to the latent image. A movement speed of the latent image carrier and a linear velocity of the toner carrier are set to approximately equivalent speeds.

BRIEF DESCRIPTION OF THE DRAWINGS

The above and other objects, features and advantages of the present invention will become more apparent from the following detailed description taken with the accompanying drawings in which:

FIG. 14 is a diagram showing roller linear velocities and the states of images formed as a result thereof.

DESCRIPTION OF THE PREFERRED EMBODIMENT(s)

Figure 1:
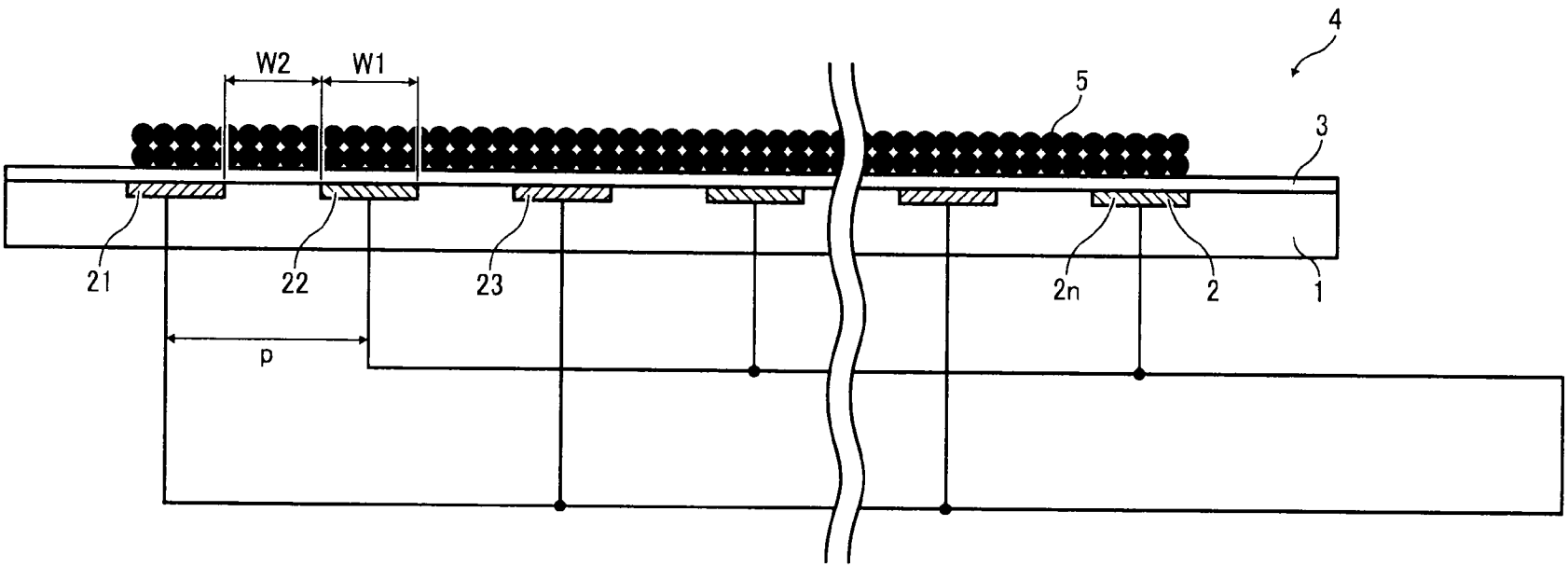
FIG. 1 is a cross-sectional view showing a system used in testing related to the present invention.

The present invention will be explained hereinbelow by referring to the drawings.

First, testing carried out during the process for achieving the present invention will be explained.

As shown in FIG. 1, an electrode pattern 2 comprising a plurality of electrodes 21, 22, 23, . . . arranged in the direction of movement of the latent image carrier at a pitch of p[μm] is formed by depositing aluminum via vapor deposition onto a glass substrate 1, and forming a protective layer 3 thereon by applying an approximately 3[μm] thick resin coating with volume resistivity of $10^{10}$ [Ω·cm], thereby configuring a substrate 4 for use as a toner carrier, and a charged toner layer 5 is formed on top of this substrate 4.

The toner layer 5 was formed by developing a thin-film beta image on the substrate 4 using a two-component developing device not shown in the figure. A polyester-based toner with a particle diameter of approximately 6[μm] was used, and the toner charge in the state in which the toner was formed into a thin film on the substrate 4 was roughly −22[μC/g].

Figure 2:
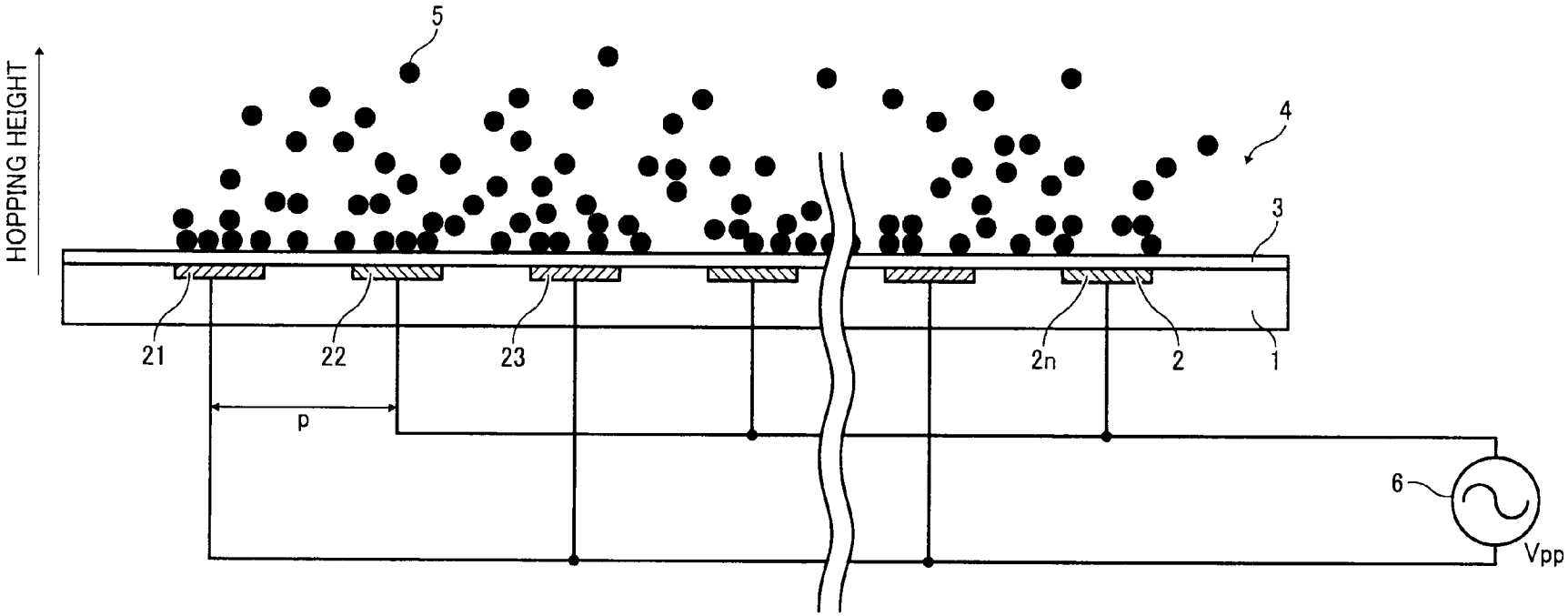
FIG. 2 is a cross-sectional view showing the flare status of this system.

As shown in FIG. 2, when an alternating current voltage from an alternating current power source 6 that serves as voltage supplying means between an odd-number electrode group, which is an aggregate of odd numbered electrodes 21, 23, . . . , and an even-number electrode group, which is an aggregate of even numbered electrodes 22, . . . , is applied to the odd-number electrode group, and the opposite phase of the above-mentioned alternating current voltage is applied to the even-number electrode group relative to a toner layer 5 in this state, the respective toner particles of the toner layer 5 carry out a movement (hopping) so as to travel back and forth between the odd-number electrode group 21, 23, . . . and the even-number electrode group 22, . . . .

The situation (state) resulting from this toner hopping movement will be called flare hereinbelow. In other words, flare is the state in which toner is pulled away from the surface of the substrate 4 by an electric field to form a cloud.

In the present invention, the state in which the toner is activated (the flare activation state) is used in development. Since the activated state is one in which toner adhesion to the toner carrier is not used, the toner is believed to be highly sensitive to air currents, electric fields and the like.

Figure 5:
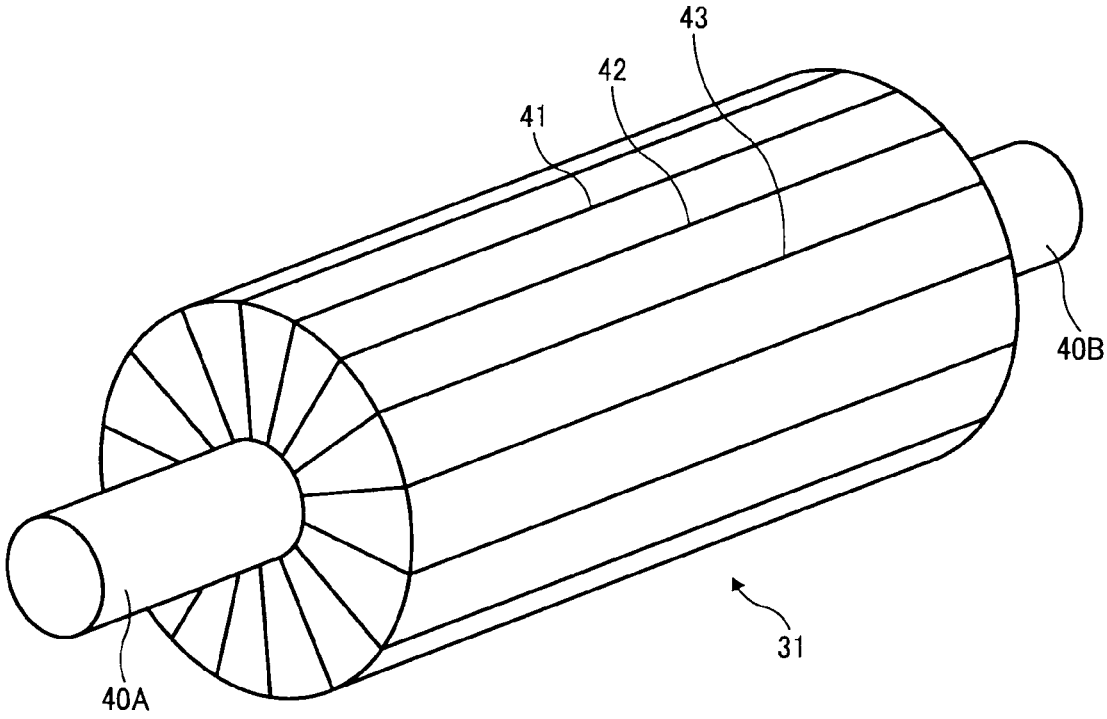
FIG. 5 is an oblique view showing a typical example of a toner carrier of the present invention.

Tests were conducted to study the effects of the rotation of the electrode roller (toner carrier) on developability. The substrate used in testing had a configuration like that shown in FIG. 1, and was configured in the shape of a roller (hereinafter will be referred to as the "flare roller") with 60 μm-wide electrodes spaced 60 μm apart. A specific example is shown in FIG. 5, and will be explained hereinbelow.

The photoreceptor that served as the latent image carrier and the flare roller were positioned opposite one another at a distance d=0.3 mm, and the opposing surfaces thereof rotated so as to move in the same direction. The linear velocity (speed of movement) of the photoreceptor was fixed at 100 mm/s, the linear velocity of the flare roller was varied, and the toner image that adhered to the photoreceptor was evaluated.

A 10 mm×10 mm square beta latent image was formed on the photoreceptor, and the state of adhesion to the photoreceptor was observed. Voltages having respective phases that differed 180 degrees were applied to the electrodes of the flare roller. A voltage of 300 Vpp was applied at a frequency of 1 kHz. The toner used had an average charge of approximately −15 μC/g, and a volume-average particle size of approximately 6 μm.

A latent image such that the potential of the non-imaging part was −500V and the potential of the imaging part was −100V was formed on the photoreceptor, and negative-positive image creation was carried out. The average value of the voltage applied to the flare roller was set at −300V. The results are shown in FIG. 14.

Based on these results, the degree of image irregularity was rank evaluated in five levels, and linear velocities around 100 mm/s were studied in detail.

The 50 mm/s and 150 mm/s linear velocities shown in FIG. 14 were both ranked 1, and the linear velocity of 100 mm/s was assigned a ranking of 5. Rank 1 is a state in which there are clear irregularities of 1 mm or more in width, rank 3 is a state in which, although slight, there are clear irregularities, rank 5 is a state in which irregularities are not apparent, rank 2 and rank 4 were intermediate states thereof, and rank 4 or higher was treated as permissible states.

Figure 3:
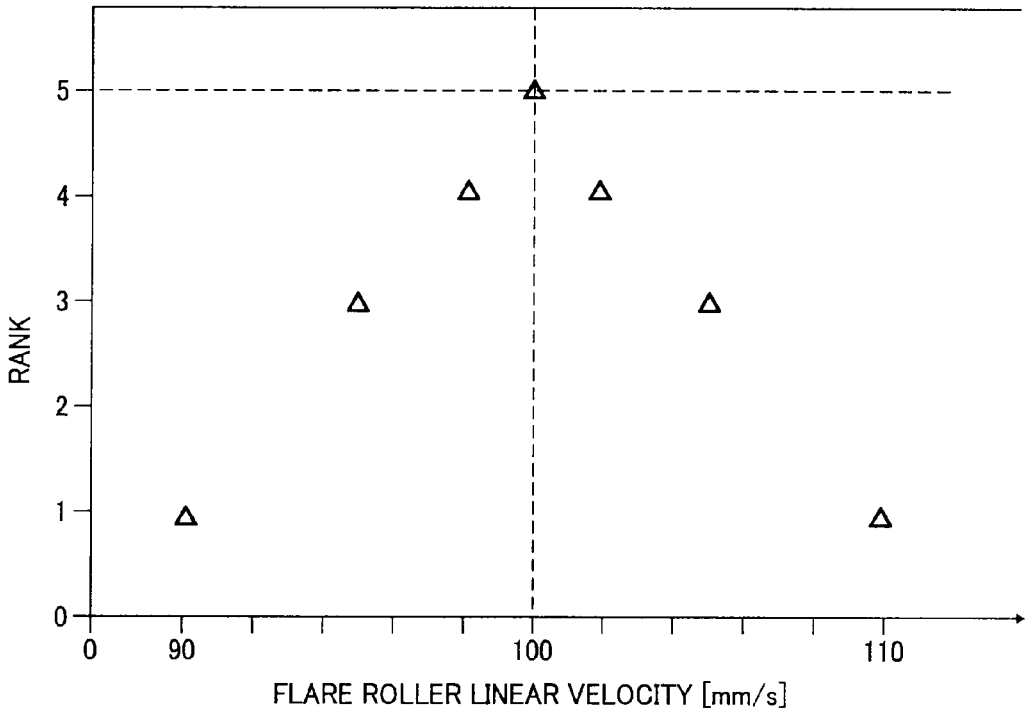
FIG. 3 is a graph of test results showing the relationship between the linear velocity of a flare roller and the ranking of image irregularities.

The results, as shown in FIG. 3, showed that a flare roller linear velocity of 95 mm/s constituted rank 3, 98 mm/s constituted rank 4, 105 mm/s constituted rank 3, and 102 mm/s constituted rank 4.

In this case, flare roller linear velocities from 98 mm/s to 102 mm/s relative to the photoreceptor linear velocity of 100 mm/s produced beta images within permissible values. It is believed that when the linear velocities differ when the toner cloud of the flare roller surface moves to the vicinity of the opposing photoreceptor, this toner cloud is affected by an air current that causes irregularities in the cloud, resulting in irregularities in the image density.

That is, it is conjectured that when the linear velocity of the flare roller is greater than the linear velocity of the photoreceptor, the toner cloud is blown to the upstream side in the direction of rotation of the flare roller, increasing the density of the posterior portion of the latent image on the photoreceptor, and when the linear velocity of the flare roller is less than the linear velocity of the photoreceptor, the toner cloud is blown to the downstream side in the direction of rotation of the flare roller, decreasing the density of the posterior portion of the latent image on the photoreceptor.

Figure 10:
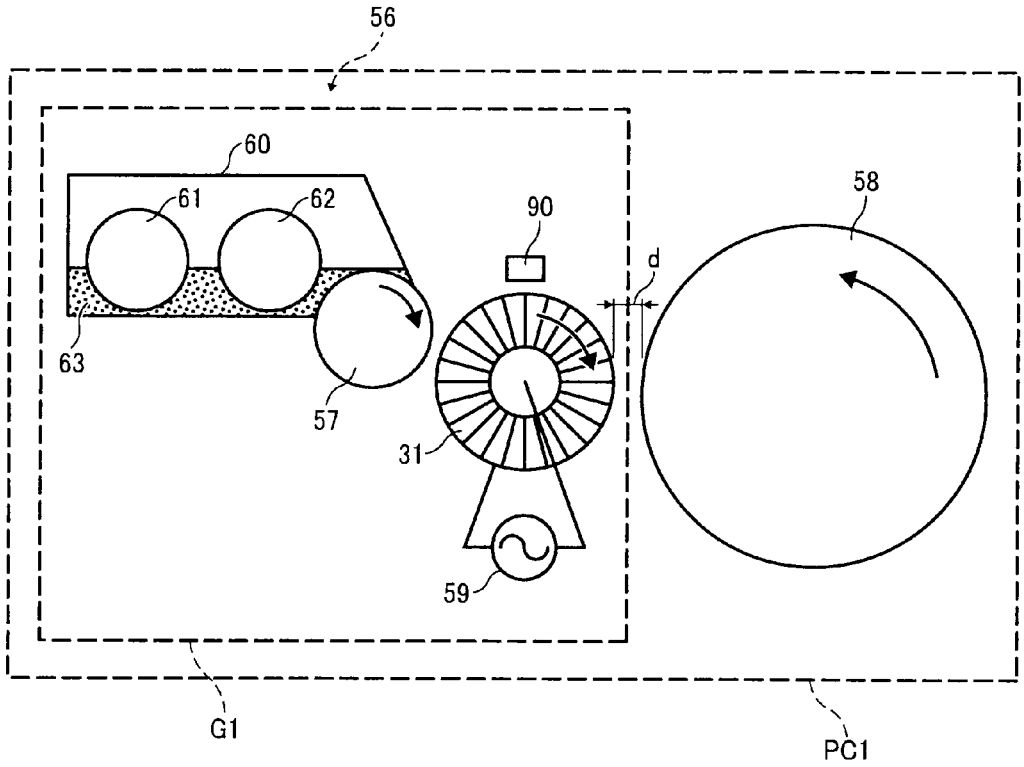
FIG. 10 is a diagram showing an overview of the configuration of an image forming apparatus related to a first embodiment.

Furthermore, testing was also conducted by changing the distance d between the photoreceptor and the flare roller (Refer to FIG. 10). When the distance was narrowed by making d smaller than in the above-described testing, a different sort of image irregularity was seen. This irregularity nearly matched the electrode pitch, making it conceivable that irregularities in the amount of toner that adhered to the photoreceptor occurred when density variations in the amount of toner that was hopping on top of the electrodes arose in accordance with the strength or weakness of the electric field over the electrode pattern, and the surface of the photoreceptor was set at a distance approaching the toner hopping height.

Since the linear velocities of the photoreceptor and flare roller were set at nearly the same speed, it is conceivable that the density variations in the hopping toner are apt to manifest themselves by becoming density irregularities as-is. It was learned that the relationship between electrode pitch p and d affected this image development, with these irregularities occurring when d<p, and that making d>p is effective at preventing electrode-based pitch irregularities.

Figure 4:
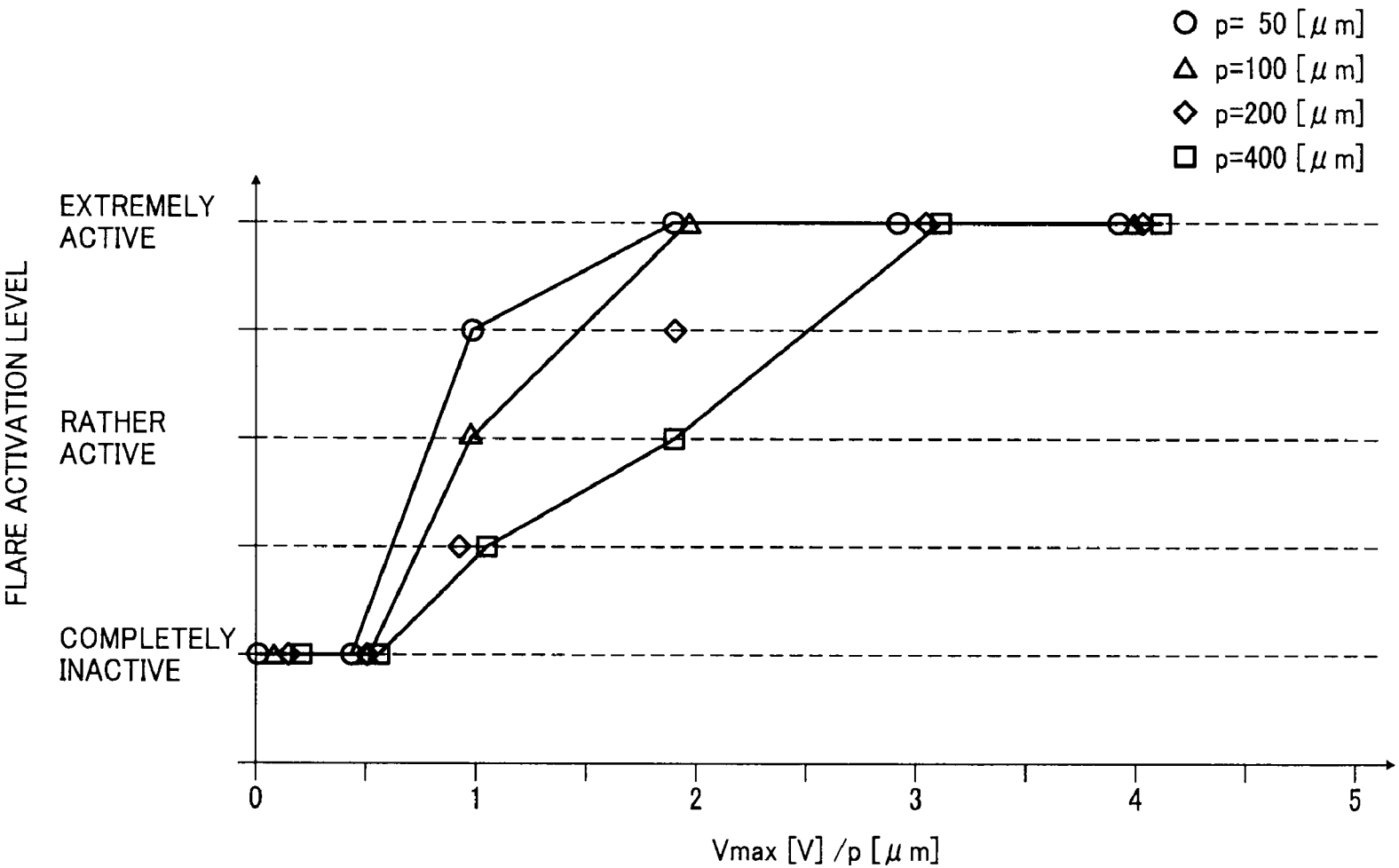
FIG. 4 is a characteristics diagram showing the relationship between the Vmax[V]/p[μm], which is the test result of this system, and the flare activation level.

Using four types of substrates 4, in which the pitch of the electrodes 21, 22, 23, . . . was respectively 50, 100, 200 and 400[μm], the flare activation level was observed via a high-speed camera while oscillating (changing) by a number of points the Vmax[V], which is the absolute value of the difference between plus side peak value and the minus side peak value of the alternating current voltage applied across the electrodes 21, 22, 23, . . . from the alternating current power source 6. The results are as shown in FIG. 4. Incidentally, the width w1 of the electrodes 21, 22, 23, . . . , and the distance w2 between adjacent electrodes 21, 22, 23, . . . was set so as to constitute ½ of the pitch p of the electrodes 21, 22, 23, . . . (Refer to FIG. 1).

The flare activation level was determined here using a five level sensory evaluation by observing the state of the unmoving toner adhering to the surface of the substrate 4. The fact that the flare activation level is nearly unequivocally achieved as a result of Vmax[V]/p[μm] regardless of the values of Vmax or p can be ascertained from FIG. 4. Then, it was learned that flare activation commences when Vmax[V]/p [μm]>1, and that flare is completely activated at Vmax[V]/p [μm]>3.

When the flare activation level is low, the activation of the toner layer on the toner carrier is insufficient, and there is no activation in places, variations in density arise in the hopping toner on the toner carrier. In particular, when development is carried out by making the linear velocity of the latent image carrier nearly the same speed as the linear velocity of the toner carrier, toner adherence irregularities corresponding to the variations in density of the hopping toner occur, causing a marked loss of image uniformity.

A flare roller having an electrode pitch of 200 μm was used, the applied voltage was varied to change the flare activation level, and the presence or absence of beta image irregularities was observed. Irregularities were not observed when the flare activation level was 3, and the irregularities at 2.5 or above were insignificant.

FIG. 5 shows a typical example of a toner carrier (flare roller) of this embodiment.

The toner carrier (hereinafter also referred to as the "toner bearing roller") 31 is configured in the shape of a rotational roller, and is able to rotate by using as an axis of rotation an electrode shaft 40A that bundles together an odd number electrode group, which is an aggregate of odd numbered electrodes, and an electrode shaft 40B that bundles together an even number electrode group, which is an aggregate of even numbered electrodes, of an electrode pattern comprising a plurality of electrodes 41, 42, 43, . . . , which is spatially periodically arranged in the direction of movement arrayed at a pitch of p[μm].

Alternating current voltage is applied to the respective electrode shafts 40A, 40B as bias potential from the alternating current power source using an electrode brush not shown in the figure. The applied voltage will be explained in detail hereinbelow.

Figure 6A:
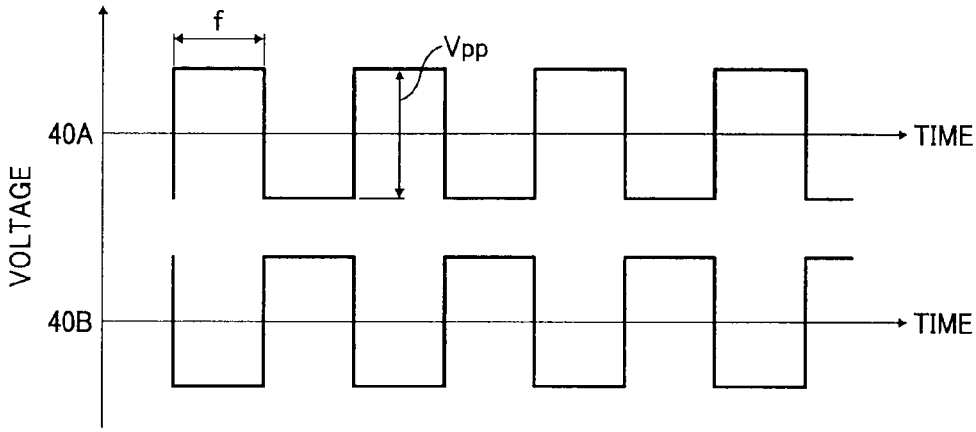
FIGS. 6A and 6B are waveform views showing the characteristics of a pulse voltage applied to an electrode of the toner carrier.

As shown in FIG. 6A, a square-wave alternating current voltage is applied to the electrode shaft 40A that bundles together the odd number electrode group, and a square-wave alternating current voltage of the opposite phase of the voltage applied to electrode shaft 40A is applied to the electrode shaft 40B that bundles together the even number electrode group. Both have the same average potential.

Figure 6B:
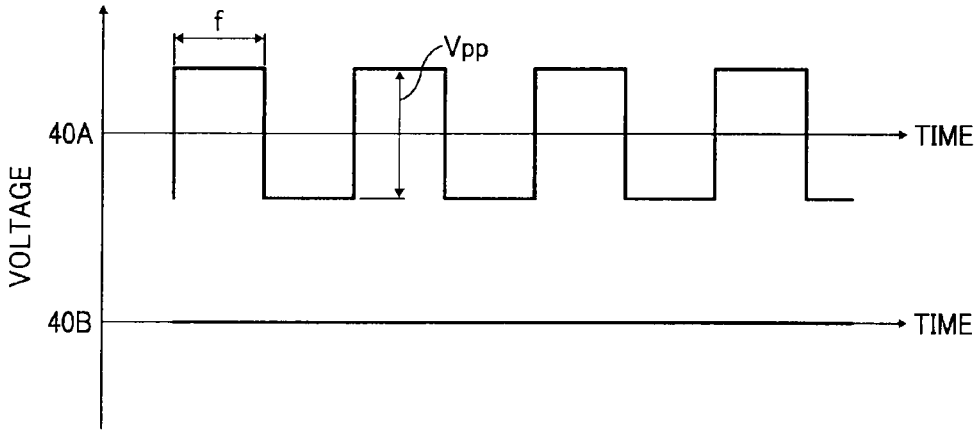

Further, as shown in FIG. 6B, the same effect can be achieved even when a square-wave alternating current voltage is applied to one side, and a direct current voltage having the same average potential as the above-mentioned alternating current voltage is applied to the other side.

Figure 7A:
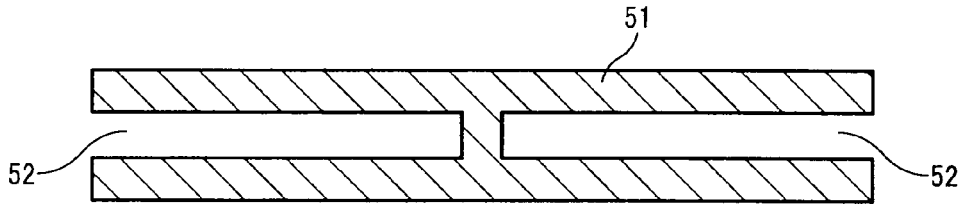
FIGS. 7A to 7C are cross-sectional views showing a part of the manufacturing process of a toner carrier.
Figure 7B:
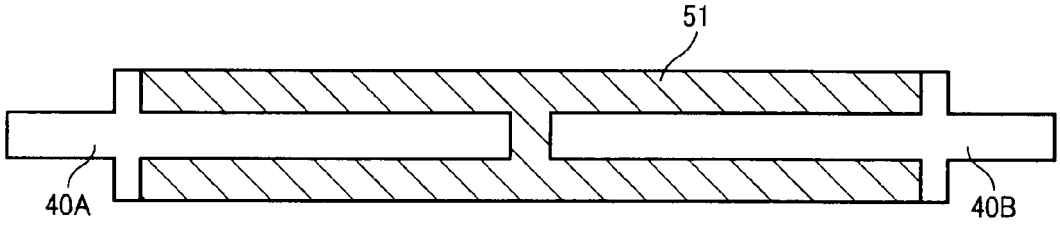
Figure 7C:
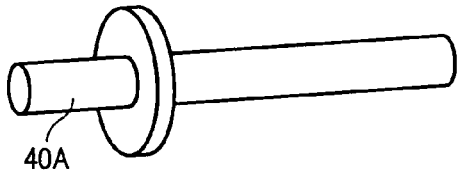

In the toner bearing roller 31, as shown in FIG. 7A, shaft holes 52 are disposed in a cylinder 51 of acrylic resin, which is an insulator, and stainless steel electrode shafts 40A, 40B, which are shown in FIG. 7C, are press fitted into the shaft holes 52 of the cylinder 51 as shown in FIG. 7B, and the electrode shafts 40A, 40B are respectively connected to the odd number electrode group 41, 43, . . . , and the even number electrode group 42, . . . .

Next, a pattern of electrodes is formed via the respective processes shown in FIGS. 8A to 8E. FIGS. 8A to 8E are figures in which the surface of the toner bearing roller 31 is deployed in the circumferential direction. In the process shown in FIG. 8A, the surface of the roller 51 produced by the processes shown in FIGS. 7A to 7C, is brought to a smooth finish using peripheral milling.

Figure 8A:
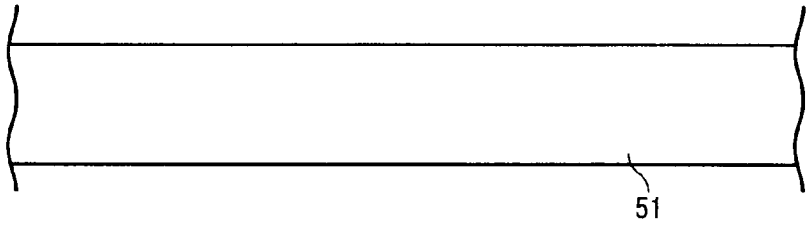
FIGS. 8A to 8E are cross-sectional views showing another part of the manufacturing process of the toner carrier.
Figure 8B:
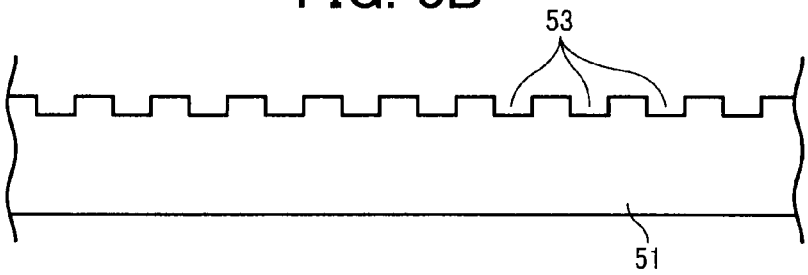
Figure 8C:
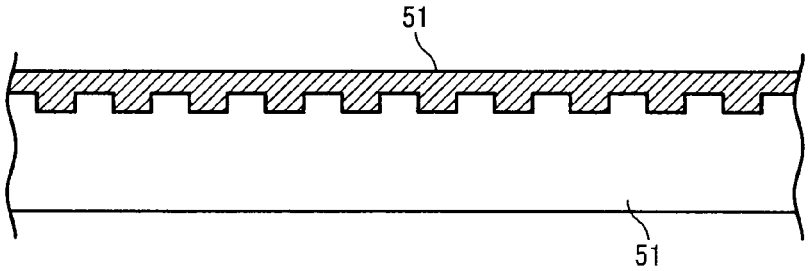
Figure 8D:
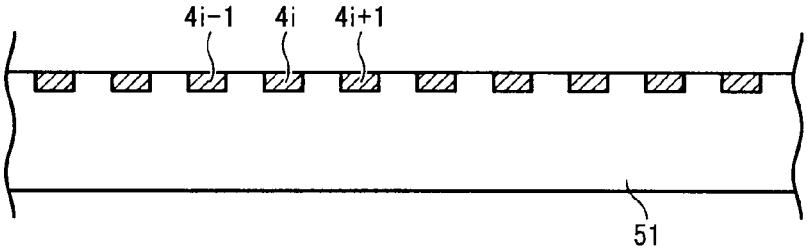
Figure 8E:
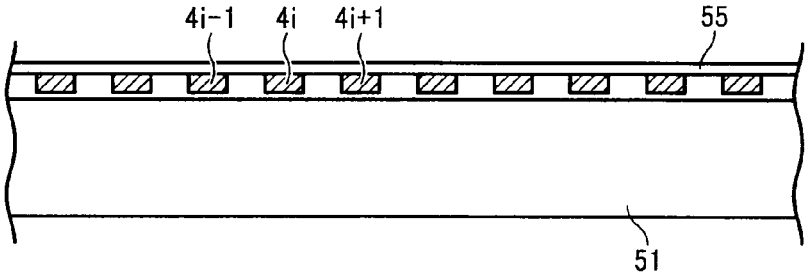

In the process shown in FIG. 8B, grooves 53 are cut so as to constitute a groove pitch of 100[μm] and a groove width of 50[μm]. In the process shown in FIG. 8C, the roller 51 into which the grooves have been cut is plated with a non-electrolytic nickel 54, and in the process shown in FIG. 8D, extraneous conductive film is removed by milling the periphery of the non-electrolytic nickel 54 plated toner bearing roller 31.

At this point, the electrodes 41, 42, 43, . . . are formed in the groove 53 parts and are mutually insulated from one another. Thereafter, the surface of the roller 51 is made smooth by coating the roller 51 with a silicon resin, simultaneously forming a surface protective layer (approximately 5[μm] thick, with volume resistivity of roughly $10^{10}$[Ω·cm]) 55, thus completing the manufacture of the toner bearing roller 31.

Figure 9:
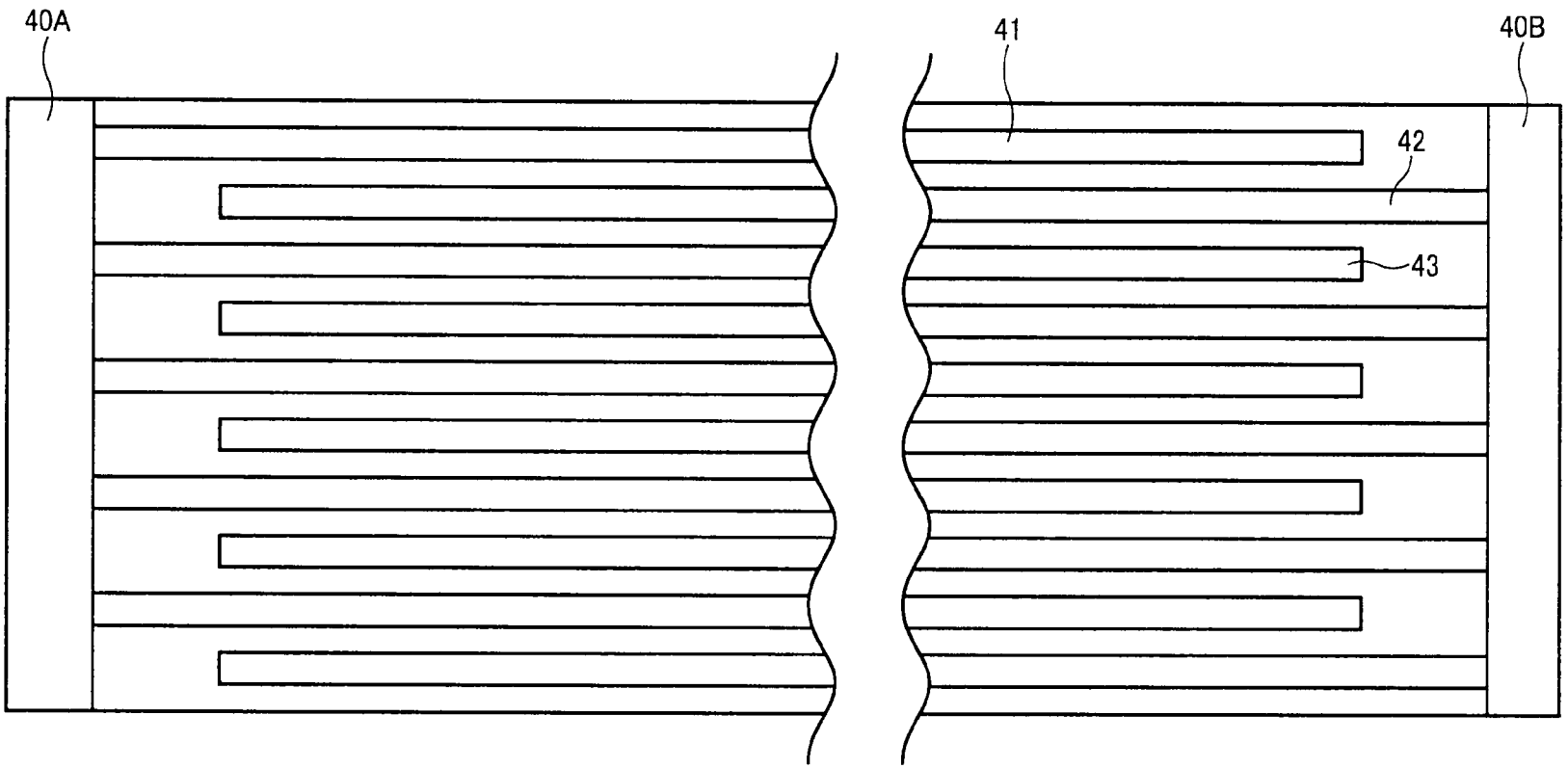
FIG. 9 is a plan view showing a toner carrier deployed in a flat shape.

FIG. 9 shows the toner bearing roller 31 deployed in a planar state.

When a thin layer of toner is formed on top of the protective layer 55 of the toner bearing roller 31 the same as on the substrate 4 described hereinabove, and an alternating current voltage is applied as a bias potential to the electrode shafts 40A, 40B from a not-shown alternating current power source using a electrode brush or the like, the toner carries out movement (called either hopping or flare) so as to move back and forth between the odd number electrode group 41, 43, . . . and the even number electrode group 42, . . . . The absolute value of the difference between the plus side peak value and the minus side peak value of the alternating current voltage applied across the electrodes 41, 42, 43, . . . from the alternating current power source is the Vmax[V], flare activation commences when Vmax[V]/p[μm]>1, and flare activation is complete at Vmax[V]/p[μm]>3.

Further, the volume resistivity of the surface layer 55 of the toner bearing roller 31 should properly fall within the range of $10^9$ [Ω·cm] to $10^{12}$ [Ω·cm] the same as for the above-described substrate 4, and the surface layer 55 is silicon resin. It is preferable that the material of the surface layer 55, as described hereinabove, apply a regular charge to the toner by creating friction with the toner, and, for example, it is preferable to use glass, or a material used in the carrier coating of a two-component developer.

As described above, the electrode pitch p is set smaller than the development gap d, that is, p<d.

A first embodiment of the present invention is shown in FIG. 10. This embodiment is an image-forming apparatus having a developing device that uses the above-described toner bearing roller 31.

The crests of a two-component developer are brought into contact with the toner bearing roller 31 using a normal two-component development unit 56. Specifically, the two-component development unit 56 transports the two-component developer, which is a mixture of a magnetic carrier powder with a particle size of 50[μm] and a polyester toner having a particle size of approximately 6[μm] at a ratio by weight of between 7 and 8[wt %], to the toner bearing roller 31 using a magnetic sleeve 57, which has a permanent magnet embedded inside, and a portion of the toner is thereby transferred to the toner bearing roller 31 in accordance with a direct current bias potential that is applied between the magnetic sleeve 57 and the toner bearing roller 31.

The toner, which has been transferred to the toner bearing roller 31, is transported to the facing part of a latent image carrier 58 by the toner carrier 31 being rotationally driven by a drive unit not shown in the figure while forming a flare on the toner bearing roller 31, and adheres to an electrostatic latent image on the latent image carrier 58 in accordance with a difference between the average potential of the surface of the toner bearing roller 31 and the potential of the latent image carrier 58, thereby developing this electrostatic latent image to form a toner image.

Furthermore, an alternating current voltage from an alternating current power source 59 that serves as voltage supplying means is applied as a bias potential across the electrode shafts 40A, 40B by an electrode brush or the like, and a temporally periodic potential difference is formed between the odd number electrode group 41, 43, . . . and the even number electrode group 42, . . . .

Extraneous toner that did not contribute to development is once again returned to the magnetic sleeve 57 from the development area. Since a flare has been formed, the adhesion of the toner to the toner bearing roller 31 is very weak, and the toner that has been returned from the development area by the toner bearing roller 31 is easily scraped off and leveled by the crests of the two-component developer, which has kept pace with the rotation of the magnetic sleeve 57.

By repeating this process, a nearly fixed amount of toner flare is formed at all times on the toner bearing roller 31. The two-component development unit 56 transports and circulates the two-component developer 63 inside a container 60 while stirring this developer 63, and the magnetic sleeve 57 transports a portion of this two-component developer to the toner bearing roller 31, and, in addition, returns the extraneous toner that did not contribute to development from the development area.

Toner quantity detecting means 90 for detecting the amount of toner on the toner carrier 31 is disposed in the vicinity of the toner carrier 31. Toner quantity detecting means 90 is configured from an optical sensor, and detects the quantity of toner by measuring the amount of reflected light from the surface of the toner carrier 31.

The developing device G1 is configured from the two-component development unit 56, a toner carrier 31, alternating current power source 59, and toner quantity detecting means 90, and these components together with the latent image carrier 58 configure a process cartridge PC1 that can be freely attached to and detached from an image-forming apparatus main unit not shown in the figure.

The latent image carrier 58 explained hereinbelow makes use of a 13[μm] thick organic photoreceptor, and uses a 1200 dpi laser writing system to form a latent image. The photoreceptor 58 is rotationally driven by a drive unit, uniformly charged by a charging device, and exposed by the not-shown laser writing system that serves as exposing means to form an electrostatic latent image.

In this case, the electrostatic latent image is formed under conditions such that the charge potential of the photoreceptor 58 is from −500V to −300V, and the write potential in the beta area becomes −50V.

This electrostatic latent image constitutes a toner image developed by toner that forms a flare on the toner carrier 31. The electrostatic latent image was realized at this time by using toner having a particle size of roughly 6[μm] under a charge of roughly −22[μC/g], and setting conditions such that there was no soiling, there was good fill in of the beta area, and, in addition, a 1200 dpi dot was capable of being reproduced, the gap between the toner carrier 31 and the photoreceptor 58 was roughly 50[μm], and an alternating current bias having an average potential of −200[V] at the respective moments when the peak values are −400[V] and 0[V], respectively, was applied to the odd number electrode group and even number electrode group of the toner carrier 31 from the alternating current power source 59 at a frequency of 2[kHz]. The alternating current biases of the odd number electrode group and the even number electrode group are opposite phase.

Although not shown in the figure, the toner image on the latent image carrier 58 is transferred via transferring means to a recording medium, such as recording paper, which has been fed from a sheet feeding device, and the toner image is fixed to this recording medium by a fixing device and ejected outside.

Figure 11:
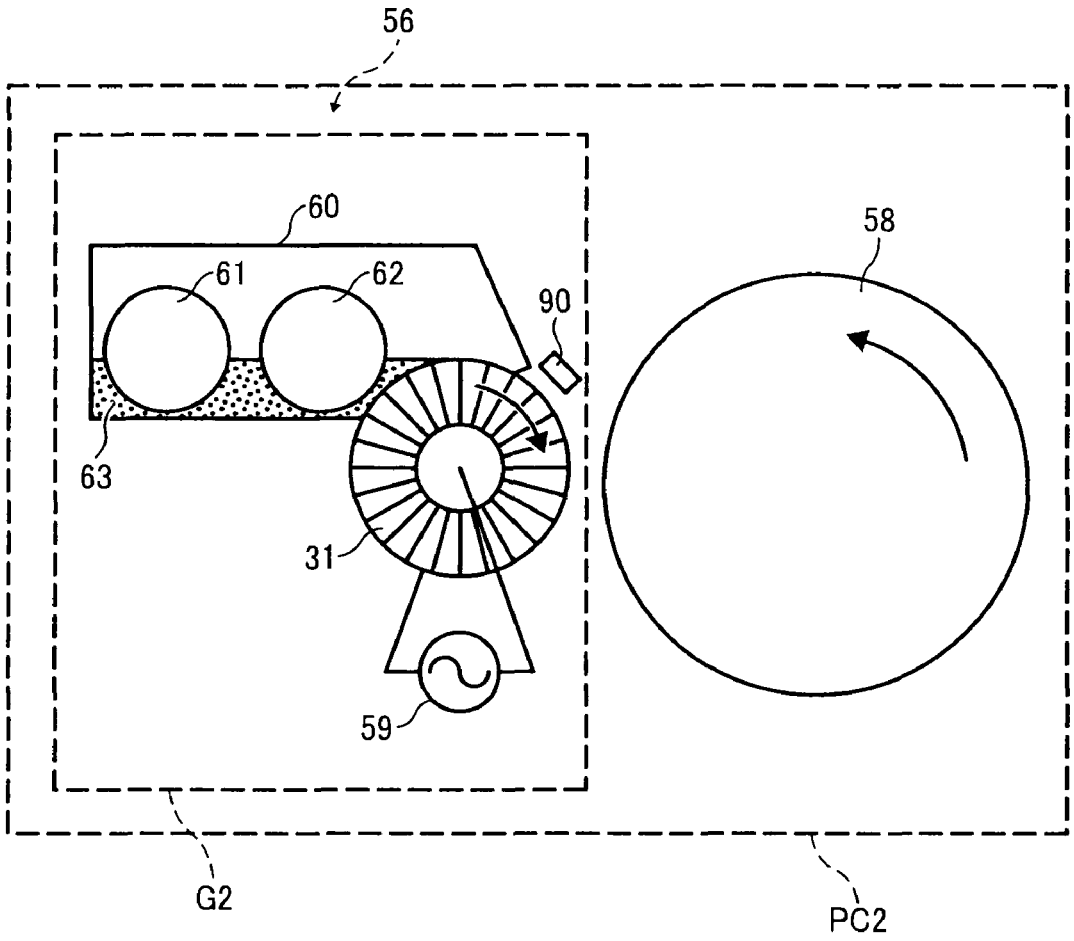
FIG. 11 is a diagram showing an overview of the configuration of an image forming apparatus related to a second embodiment.

FIG. 11 shows a second embodiment. In this embodiment, the configuration has been simplified by omitting the magnetic sleeve 57 in the embodiment shown in FIG. 10, and toner is supplied to the toner bearing roller 31 by a cascade development process with the two-component developer.

Since the development unit 56 uses a simple cascade process to form a thin layer of toner on the toner bearing roller 31, the toner transfer rate to the toner bearing roller 31 declines compared to the embodiment shown in FIG. 10, but it is possible to support the development speed of the photoreceptor 58 by increasing the speed of rotation of the toner bearing roller 31 accordingly.

Since the developing device of this embodiment, which comprises a two-component development unit 56 without the magnetic sleeve 57 and the toner bearing roller 31, is substantially the same size as a conventional two-component development unit, it is possible to configure a compact, high-quality image creation engine.

Accordingly, in accordance with this embodiment it is possible to realize higher image quality, and, in addition, more compactness than that of the prior art.

The developing device G2 is configured from the two-component development unit 56, toner carrier 31, alternating current power source 59 and toner quantity detecting means 90, and these components together with the latent image carrier 58 configure a process cartridge PC2 that can be freely attached to and detached from an image-forming apparatus main unit not shown in the figure.

Figure 12:
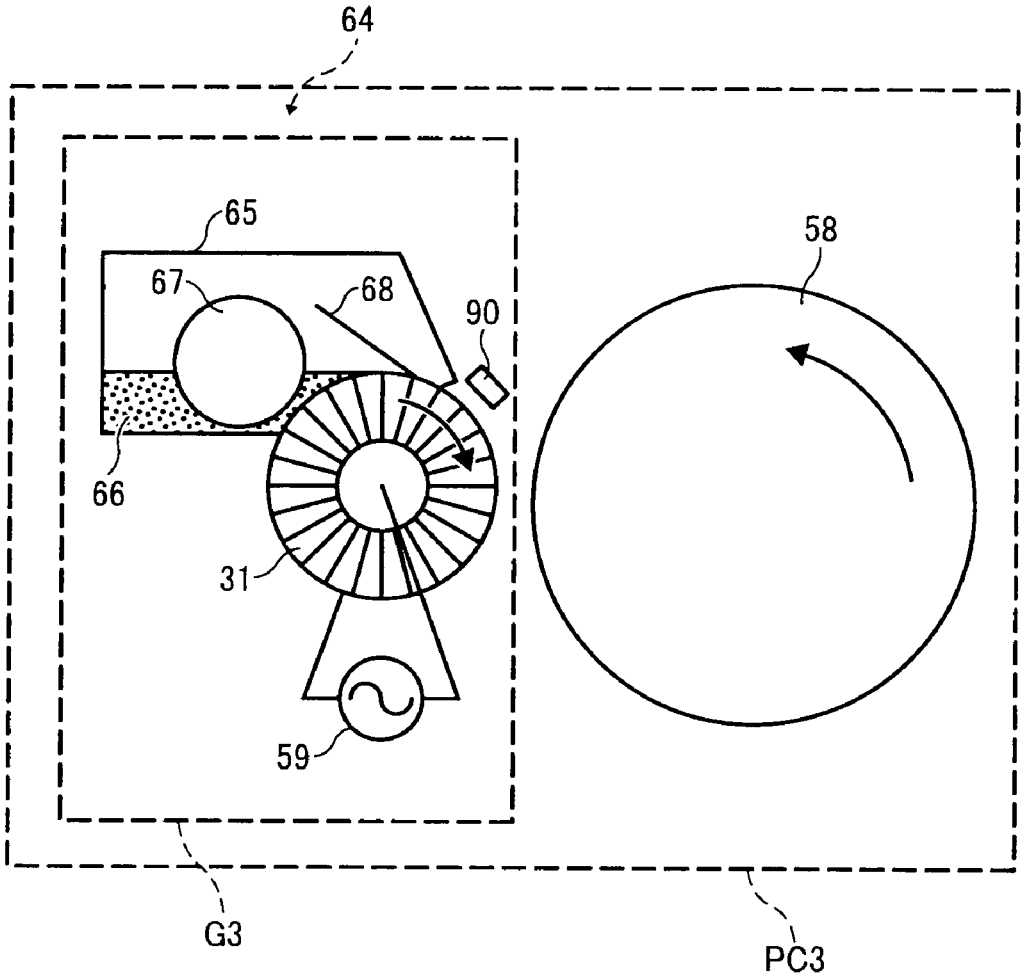
FIG. 12 is a diagram showing an overview of the configuration of an image forming apparatus related to a third embodiment.

FIG. 12 shows a third embodiment. In this embodiment, a one-component development unit 64 having only toner is used in place of the two-component development unit 56 of the embodiment shown in FIG. 10, and this one-component development unit 64 transfers toner to the toner bearing roller 31 to form a thin layer of toner on the toner bearing roller 31.

In this case, the one-component development unit 64 supplies the toner 66 inside a container 65 to the toner bearing roller 31 while stirring and circulating this toner 66 with a circulation paddle 67, and forms the toner on the toner bearing roller 31 into a thin layer of toner by regulating this toner to a fixed thickness using a metering blade 68 as a toner regulating member.

From the standpoint of the stability of the supply of toner to the toner bearing roller 31, this embodiment is slightly inferior to the embodiments shown in FIGS. 10 and 11, but this problem can be solved by working out the conditions, and, above all, this embodiment can provide an extremely compact, lightweight, high image quality developing device.

Accordingly, in accordance with this embodiment it is possible to realize high image quality that is exceedingly more uniform, and, in addition, more compact than that of the prior art.

The developing device G3 is configured from the one-component development unit 64, toner carrier 31, alternating current power source 59 and toner quantity detecting means 90, and these components together with the latent image carrier 58 configure a process cartridge PC3 that can be freely attached to and detached from an image-forming apparatus main unit not shown in the figure.

Figure 13:
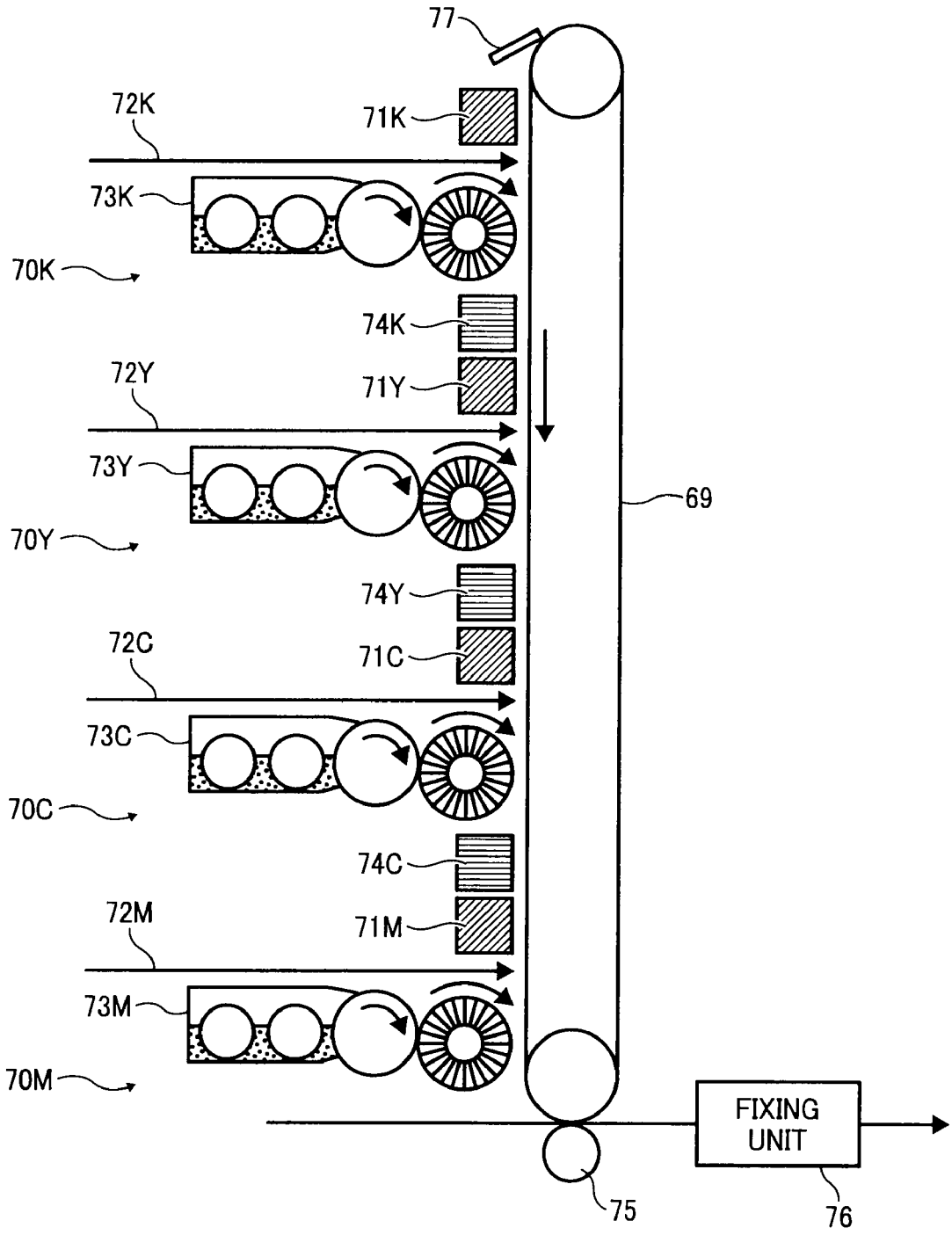
FIG. 13 is a diagram showing an overview of the configuration of an image forming apparatus related to a fourth embodiment.

FIG. 13 shows a fourth embodiment. This embodiment is configured using the same developing device as the developing device that comprises the two-component development unit 56 and toner bearing roller 31 of the embodiment shown in FIG. 10, and is an example of an image forming apparatus that superimposingly forms a toner image of respective colors on a photoreceptor.

In this embodiment, a belt-shaped organic photoreceptor 69 that serves as the latent image carrier is stretched between two rollers not shown in the figure and is rotationally driven by a drive member not shown in the figure.

On the left side of the photoreceptor 69, there is arrayed a plurality of image creation devices 70K, 70Y, 70C, 70M serving as image forming means that respectively form images of a plurality of colors, for example, black, yellow cyan and magenta. An electrostatic image is formed on the photoreceptor 69 by first using a charging device 71K to uniformly charge the image creation device 70K, and using an optical beam 72K that has been modulated with black image data to carry out exposure using a not-shown writing device that serves as exposing means, and this electrostatic latent image is developed by a developing device 73K having the same configuration as the developing device comprising the two-component development unit 56 and toner bearing roller 31 of the embodiment shown in FIG. 10, thereby creating a black toner image. Thereafter, the electrical charge of the photoreceptor 69 is neutralized by a neutralizing unit 74K in preparation for forming the next image.

Next, an electrostatic image is formed on the photoreceptor 69 by using a charging device 71Y to uniformly charge the image creation device 70Y, and using an optical beam 72Y that has been modulated with yellow image data to carry out exposure using a not-shown writing device that serves as exposing means, and this electrostatic latent image is developed by a developing device 73Y having the same configuration as the developing device comprising the two-component development unit 56 and toner bearing roller 31 of the embodiment shown in FIG. 10, thereby creating a yellow toner image superimposed on the above-mentioned black toner image. Thereafter, the photoreceptor 69 is neutralized by a neutralizing unit 74Y in preparation for forming the next image.

Next, an electrostatic image is formed on the photoreceptor 69 by using a charging device 71C to uniformly charge the image creation device 70C, and using an optical beam 72C that has been modulated with cyan image data to carry out exposure using a not-shown writing device that serves as exposing means, and this electrostatic latent image is developed by a developing device 73C having the same configuration as the developing device comprising the two-component development unit 56 and toner bearing roller 31 of the embodiment shown in FIG. 10, thereby creating a cyan toner image superimposed on the above-mentioned yellow toner image and above-mentioned black toner image. Thereafter, the photoreceptor 69 is neutralized by a neutralizing unit 74C in preparation for forming the next image.

Next, an electrostatic image is formed on the photoreceptor 69 by using a charging device 71M to uniformly charge the image creation device 70M, and using an optical beam 72M that has been modulated with magenta image data to carry out exposure using a not-shown writing device that serves as exposing means, and this electrostatic latent image is developed by a developing device 73M having the same configuration as the developing device comprising the two-component development unit 56 and toner bearing roller 31 of the embodiment shown in FIG. 10, thereby forming a full-color image by creating a magenta toner image superimposed on the above-mentioned cyan toner image, the above-mentioned yellow toner image and the above-mentioned black toner image.

Meanwhile, a recording sheet or other such recording medium is supplied from a sheet feeding device not shown in the figure, and the full-color image on the photoreceptor 69 is transferred to this recording medium by a transfer roller 75 that serves as transferring means to which a transfer bias is applied from a power source. The full-color image is affixed to the recording medium to which the full-color image has been transferred by a fixing device 76, and the recording medium is ejected outside. Residual toner is removed from the photoreceptor 69 subsequent to the transfer of the full-color image by a cleaner 77 that serves as cleaning means.

Furthermore, the developing devices 73K, 73Y, 73C, 73M can utilize either the developing device comprising the two-component development unit 56 and toner bearing roller 31 of FIG. 11 or the developing device comprising the one-component development unit 64 and toner bearing roller 31 of FIG. 12.

In this embodiment, since a four-color write is carried out to the same photoreceptor 69, as a rule, there is nearly no displacement as compared to the normal quadruple photoreceptor tandem system, making it possible to layer four colors on the photoreceptor to produce a high-quality full-color image with no displacement. Further, since there is absolutely no impact on a toner image once it has been formed on the photoreceptor 69 using the developing device of the above-described embodiment, scavenging and the mixing of colors are not problems, making it possible to realize a high-quality image creation process that can be stably carried out for a long period of time.

According to the above present invention, since the movement speed of the latent image carrier is approximately equivalent to the linear velocity of the toner carrier, it is possible to curb image density nonuniformity resulting from toner cloud imbalance, enabling the realization of high image quality. Further, the fact that the velocities of the latent image carrier and toner carrier are simply adjusted contributes toward making the developing device more compact. Further, since good color layering is possible on the latent image carrier, a high-quality full-color image can be achieved with no displacement.

Various modifications will become possible for those skilled in the art after receiving the teachings of the present disclosure with departing from the scope thereof.

What is claimed is:

1. A developing device comprising:

a toner carrier arranged opposing a latent image carrier;

a plurality of electrodes disposed in the toner carrier; and voltage supplying means for supplying a voltage to said electrodes such that an electric field across said plurality of electrodes is temporally switched, said electric field causing a toner carried on a surface of said toner carrier to carry out hopping to form a toner cloud, a latent image formed on said latent image carrier being developed by causing the toner to adhere to the latent image, and a movement speed of said latent image carrier and a linear velocity of said toner carrier being set to approximately equivalent speeds.

2. The developing device as claimed in claim 1, wherein, when the movement speed of said latent image carrier and the linear velocity of said toner carrier are the same and is used as a reference, a deviation of the linear velocity of said toner carrier is within around 2%.

3. The developing device as claimed in claim 1, wherein, when a distance between said latent image carrier and said toner carrier is d, and a pitch between said electrodes in a direction of movement of said latent image carrier is p, d>p is established.

4. The developing device as claimed in claim 1, wherein, when an absolute value of a potential difference between said electrodes is Vmax[V], Vmax/p>2.5 is established, p being a pitch between said electrodes in a direction of movement of said latent image carrier.

5. The developing device as claimed in claim 1 further comprising a development unit for supplying toner to said toner carrier, wherein said development unit holds a two-component developer.

6. The developing device as claimed in claim 1, further comprising a development unit for supplying toner to said toner carrier, wherein said development unit holds a one-component developer.

7. The developing device as claimed in claim 1, wherein the voltage supplying means applies a first voltage to odd numbered electrodes from among said plurality of electrodes and applies a second voltage to even numbered electrodes from among said plurality of electrodes, said first voltage being opposite in phase with respect to the second voltage.

8. A process cartridge, which integrally comprises at least a latent image carrier and a developing device, and which can be freely attached to and detached from an image forming apparatus main unit, said developing device comprising:

a toner carrier arranged opposing a latent image carrier;

a plurality of electrodes disposed in the toner carrier; and voltage supplying means for supplying a voltage to said electrodes such that an electric field across said plurality of electrodes is temporally switched, said electric field causing a toner carried on a surface of said toner carrier to carry out hopping to form a toner cloud, a latent image formed on said latent image carrier being developed by causing the toner to adhere to the latent image, and a movement speed of said latent image carrier and a linear velocity of said toner carrier being set to approximately equivalent speeds.

9. The process cartridge as claimed in claim 8, wherein, when the movement speed of said latent image carrier and the linear velocity of said toner carrier are the same and is used as a reference, a deviation of the linear velocity of said toner carrier is within around 2%.

10. The process cartridge as claimed in claim 8, wherein, when a distance between said latent image carrier and said toner carrier is d, and a pitch between said electrodes in a direction of movement of said latent image carrier is p, d>p is established.

11. The process cartridge as claimed in claim 8, wherein, when an absolute value of a potential difference between said electrodes is Vmax[V], Vmax/p>2.5 is established, p being a pitch between said electrodes in a direction of movement of said latent image carrier.

12. The process cartridge as claimed in claim 8 further comprising a development unit for supplying toner to said toner carrier, wherein said development unit holds a two-component developer.

13. The process cartridge as claimed in claim 8, further comprising a development unit for supplying toner to said toner carrier, wherein said development unit holds a one-component developer.

14. The process cartridge as claimed in claim 8, wherein the voltage supplying means applies a first voltage to odd numbered electrodes from among said plurality of electrodes and applies a second voltage to even numbered electrodes from among said plurality of electrodes, said first voltage being opposite in phase with respect to the second voltage.

15. An image forming apparatus, which comprises a developing device, said developing device comprising:

a toner carrier arranged opposing a latent image carrier;

a plurality of electrodes disposed in the toner carrier; and voltage supplying means for supplying a voltage to said electrodes such that an electric field across said plurality of electrodes is temporally switched, said electric field causing a toner carried on a surface of said toner carrier to carry out hopping to form a toner cloud, a latent image formed on said latent image carrier being developed by causing the toner to adhere to the latent image, and a movement speed of said latent image carrier and a linear velocity of said toner carrier being set to approximately equivalent speeds.

16. The image forming apparatus as claimed in claim 15, wherein, when the movement speed of said latent image carrier and the linear velocity of said toner carrier are the same and is used as a reference, a deviation of the linear velocity of said toner carrier is within around 2%.

17. The image forming apparatus as claimed in claim 15, wherein, when a distance between said latent image carrier and said toner carrier is d, and a pitch between said electrodes in a direction of movement of said latent image carrier is p, $d>p$ is established.

18. The image forming apparatus as claimed in claim 15, wherein, when an absolute value of a potential difference between said electrodes is Vmax[V], $Vmax/p>2.5$ is established, p being a pitch between said electrodes in a direction of movement of said latent image carrier.

19. The image forming apparatus as claimed in claim 15, further comprising a development unit for supplying toner to said toner carrier, wherein said development unit holds a two-component developer.

20. The image forming apparatus as claimed in claim 15, further comprising a development unit for supplying toner to said toner carrier, wherein said development unit holds a one-component developer.

21. The image forming apparatus as claimed in claim 15, further comprising a plurality of either said developing device or a process cartridge, wherein color-layering is carried out a plurality of times on said latent image carrier.

22. The image forming apparatus as claimed in claim 15, wherein the voltage supplying means applies a first voltage to odd numbered electrodes from among said plurality of electrodes and applies a second voltage to even numbered electrodes from among said plurality of electrodes, said first voltage being opposite in phase with respect to the second voltage.

* * * * *